United States Patent [19]

Singhal et al.

[11] Patent Number: 4,853,110

[45] Date of Patent: Aug. 1, 1989

[54] METHOD FOR SEPARATING ARSENIC AND/OR SELENIUM FROM SHALE OIL

[75] Inventors: Gopal H. Singhal, Houston; Daniel F. Ryan, Friendswood, both of Tex.

[73] Assignee: Exxon Research and Engineering Company, Florham Park, N.J.

[21] Appl. No.: 925,676

[22] Filed: Oct. 31, 1986

[51] Int. Cl.[4] ..... C10G 29/04

[52] U.S. Cl. ..... 208/253; 208/177; 208/282; 208/295; 208/251 R; 208/251 H

[58] Field of Search ..... 208/253, 177, 282, 295, 208/251; 562/216

[56] References Cited

U.S. PATENT DOCUMENTS

| | | | |
|---|---|---|---|
| 2,778,779 | 1/1957 | Donaldson | 208/293 |
| 2,782,143 | 2/1957 | Bicek | 208/282 |
| 2,921,895 | 1/1960 | Gislon et al. | 208/253 |
| 3,023,160 | 2/1962 | Stedman | 208/282 |
| 3,084,750 | 4/1974 | Myers et al. | 208/251 H |
| 3,161,585 | 12/1964 | Gleim et al. | 208/251 H |
| 3,252,895 | 5/1966 | Gleim et al. | 208/251 H |
| 3,274,098 | 9/1966 | Gatsis | 208/251 H |
| 3,896,049 | 7/1975 | Dworak | 208/253 |
| 3,933,624 | 1/1976 | Myers | 208/253 |
| 3,954,603 | 5/1976 | Curtin | 208/253 |
| 4,046,674 | 9/1977 | Young | 208/253 |
| 4,051,022 | 9/1977 | Myers et al. | 208/253 |
| 4,067,799 | 1/1978 | Bearden, Jr. et al. | 208/253 |
| 4,069,140 | 1/1978 | Wunderlich | 208/253 |
| 4,075,085 | 2/1978 | Young | 208/253 |
| 4,083,924 | 4/1978 | Styring | 208/253 |
| 4,127,469 | 11/1978 | Young | 208/253 |
| 4,243,554 | 1/1981 | Naumann et al. | 423/53 |
| 4,272,361 | 6/1981 | Compton | 208/282 |
| 4,431,520 | 2/1984 | Giuliani et al. | 208/251 H |
| 4,457,835 | 7/1984 | Kukes | 208/251 H |
| 4,462,896 | 7/1984 | Kilagawa et al. | 208/251 R |
| 4,528,089 | 7/1984 | Pecoraro et al. | 208/216 R |
| 4,540,481 | 9/1985 | Sawyer et al. | 208/215 |
| 4,540,482 | 9/1985 | Seiver et al. | 208/215 |
| 4,552,646 | 11/1985 | Stapp | 208/253 |
| 4,557,823 | 12/1985 | Kukes et al. | 208/251 H |
| 4,560,468 | 12/1985 | Kukes et al. | 208/110 |
| 4,561,964 | 2/1985 | Singhal et al. | 208/420 |
| 4,564,441 | 1/1986 | Kukes et al. | 208/251 H |
| 4,578,180 | 3/1986 | Kukes et al. | 208/251 H |
| 4,582,594 | 4/1986 | Kukes et al. | 208/251 H |
| 4,592,827 | 6/1986 | Galiasso et al. | 208/96 |
| 4,612,110 | 9/1986 | Kukes et al. | 208/251 H |

FOREIGN PATENT DOCUMENTS

| | | | |
|---|---|---|---|
| 1820542 | 9/1959 | United Kingdom | 208/253 |

*Primary Examiner*—H. M. S. Sneed
*Assistant Examiner*—Helane Myers
*Attorney, Agent, or Firm*—Wayne Hoover; Chris P. Konkol

[57] ABSTRACT

A process for removing arsenic and/or selenium from carbonaceous materials. The arsenic and/or selenium are separated by reaction with a metal oxide and/or metal sulfide which is itself derived from a metal complex, and organometallic compound and/or a metal salt of an organic acid which is soluble in said carbonaceous fluid and which either decomposes to the corresponding metal oxide and/or metal sulfide or which can be converted to the corresponding metal sulfide or metal oxide. The reaction of the metal oxide and/or metal sulfide with the arsenic and/or selenium is accomplished at a temperature within the range from about 300° F. to about 800° F. preferably from about 500° F. to about 750° F., most preferably from about 680° F. to about 750° F. and in either an inert or reducing atmosphere. Preferably, the conversion is accomplished in a reducing atmosphere and in the presence of molecular hydrogen.

7 Claims, No Drawings

METHOD FOR SEPARATING ARSENIC AND/OR SELENIUM FROM SHALE OIL

BACKGROUND OF THE INVENTION

This invention relates to a method for separating certain constituents from carbonaceous fluids. More paticularly, this invention relates to a method for separating certain catalyst poisoning impurities, contaminants and/or environmental pollutants from carbonaceous fluids.

Heretofore, several processes for separating catalyst poisoning impurities, contaminants and/or environmental pollutants such as arsenic, selenium, and the like, from carbonaceous fluids have been proposed. In general, the prior art processes involve passing of the carbonaceous fluid through a fixed bed of material that will remove the catalyst poisoning impurity, contaminant and/or environmental pollutants either by absorption thereof onto a solid or by reaction therewith. Materials which will react with catalyst poisoning impurities, contaminants and/or environmental pollutants such as arsenic and selenium include the oxides and sulfides of various metals, particularly the iron group metals such as iron, nickel and cobalt. The metal oxides and metal sulfides may comprise the entire fixed bed or the same may be incorporated with a suitable carrier or support. Suitable carrier materials known in the prior art include silica, alumina, magnesia, zirconia, thoria, zinc oxide, chromium oxide, silicon carbide, naturally occurring carriers such as the clays, including special clays like fuller's earth, kieselguhr, pumice, bauxite and the like. A combination of two or more carriers may, of course, be used.

As is believed well known in the prior art, some of these carriers will act as absorbents for the catalyst poisoning impurities, contaminants and/or environmental pollutants. When the metal oxide and/or metal sulfide is, then, used in combination with such a carrier, the catalyst poisoning impurities, contaminants and/or environmental pollutants will be separated both by reaction with the metal oxide and/or metal sulfide and by absorption on the carrier. Moreover, and as indicated in U.S. Pat. No. 3,954,603 which issued on May 4, 1976, it is possible that the metal oxide and/or metal sulfide act as an absorbent.

While the prior art processes have, generally, been reasonably effective in separating arsenic and selenium from carbonaceous fluids containing the same, care must be exercised to prevent a breakthrough of catalyst poisoning impurities, contaminants and/or environmental pollutants when the bed has reached its reactive and/or absorbent limit. In such operations, then, continuous operations require a plurality of fixed beds and the spent beds must be replaced since they are not generally subject to regeneration. Moreover, the prior art processes are not particularly effective for processing shale oils and similar hydrocarbon liquids which may contain significant concentrations of fines due to irreversible plugging of the beds as a result of the fines content before the fixed bed has separated its optimum or maximum amount of catalyst poisoning impurities, contaminants and/or environmental pollutants. The need, then for an improved process for separating such catalyst poisoning impurities, contaminants and/or environmental polluntants which does not require bed replacement and which is not subject to plugging by fines or other impurities that may be contained in the carbonaceous fluid is believed readily apparent.

SUMMARY OF THE INVENTION

It has now been discovered that the foregoing and other disadvantages of the prior art processes can be avoided or at least significantly reduced with the method of the present invention and an improved process for separating catalyst poisoning impurities, contaminants and/or environmental pollutants such as arsenic and selenium from carbonaceous materials containing the same provided thereby. It is, therefore, an object of this invention to provide an improved process for separating non-metals such as arsenic and selenium from carbonaceous fluids containing the same. It is another object of this invention to provide such an improved process wherein a fixed bed of reactant and/or absorbent is not required. It is still a further object of this invention to provide such a process that may be effectively used even when the carbonaceous fluid contains significant concentrations of fines. The foregoing and other objects and advantages will become apparent from the description set forth hereinafter.

In accordance with the present invention, the foregoing and other objects and advantages are accomplished by incorporating a metal complex, an organometallic compound and/or a metal salt of an organic acid which complex, compound or salt is soluble in the carbonaceous fluid being treated and which will either decompose to the corresponding metal oxide and/or metal sulfide or which can be easily converted to the corresponding metal oxide and/or metal sulfide, converting the soluble metal compound to the corresponding metal oxide and/or metal sulfide and thereafter bringing the carbonacesou fluid to conditions at which the catalyst poisoning impurities, contaminants and/or environmental pollutants will react with the metal oxide and/or a metal sulfide and holding said carbonaceous fluid at these conditions for a sufficient period of time for the reaction to occur. The reacted catalyst poisoning impurity, contaminant and/or environmental pollutant may then be separated, as a solid, using conventional means. The reaction between the catalyst poisoning impurities, contaminants and/or environmental pollutants will be accomplished in an inert or reducing atmosphere and at an elevated temperature.

DETAILED DESCRIPTION OF THE INVENTION

As indicated, supra, the present invention relates to an improved method for separating catalyst poisoning impurities, contaminants and/or environmental pollutants such as arsenic and selenium, from carbonaceous fluids comprising the same. As also indicated, supra, the separation is effected through a reaction of the arsenic and/or selenium with an oxide and/or sulfide of a metal, which oxide and/or sulfide of a metal is a conversion or decomposition product of a metal complex, an organometallic compound or a metal salt of an organic acid. The reaction is accomplished at an elevated temperature and in an inert or reducing atmosphere.

In general, the method of the present invention may be used to separate catalyst poisoning impurities, contaminants and/or environmental pollutants such as arsenic and/or selenium from a carbonaceous fluid which is liquid at the conditions at which the arsenic and/or selenium are reacted with the metal oxide and/or metal sulfide, and which contains arsenic and/or selenium.

Suitable carbonaceous fluid feedstocks include crude oils and various distillate fractions thereof, shale oils and distillate fractions thereof, coal liquids and distillate fractions thereof, tar sand liquids and distillate fractions thereof and the like. Of the suitable carbonaceous fluids, shale oils most frequently contain significant concentrations of arsenic, and, then, the present invention is particularly effective in the separation of these materials from shale oil.

In general, any metal complex, organometallic compound or metal salt of an organic acid which complex, compound or salt is soluble in the carbonaceous fluid at the conditions of use to the extent required to provide at or near a stoichiometric amount thereof based on arsenic and selenium in the carbonaceous fluid may be used in the method of the present invention. In general, the metal may be selected from the group of metals consisting of Groups VI-A and VIII-A of the Periodic Table of the Elements, as copyrighted by Sargent-Welch Scientific Company in 1979. Suitable metal compounds which may be used in the method of the present invention include: metal complexes such as the heteropoly acids, e.g., phosphomolybdic acid, molybdosilicic acid, phosphotungstic acid, and the like; various metal chelates eg., the metal chelates of 1,3-diketones and of alkyl diamines such as ethylenediamine; metal complexes such as the metal complexes of phthalocyanines, e.g., Ni phthalocyanine; metal salts of organic acids such as the metal salts of acyclic and alicyclic carboxylic acids containing two or more carbon atoms, e.g., metal salts of naphthenic acid, metal salts of aromatic carboxylic acids such as toluic acid and toluene sulfonic acid, metal salts of carbamic acid, thio and dithiophosphoric acid, thio and dithiocarbamic acids, xanthic acid and the like; and salts of organic amines such as salts of aliphatic amines, aromatic amines and quarternary ammonium compounds.

As indicated, supra, it is essential to the method of the present invention to convert the selected precursor to the corresponding metal oxide or metal sulfide. In certain cases, this conversion may be accomplished simply by decomposing the precursor via heating. It other cases, however, it will be necessary to effect the conversion by reaction with a suitable treating agent. For example, when the oxide is the desired form, but not the decomposition product, a suitable oxidizing agent such as air or oxygen may be used. When the sulfide, on the other hand, is the desired form but not the decomposition form, treatment with a suitable sulfiding agent such as hydrogen sulfide, mercaptans and the like will be used. In either case, the conversion will be accomplished within selected temperature ranges in an appropriate environment. For example, when the oxide is the desired conversion product, the conversion will be accomplished in an oxidizing atmosphere, generally at a temperature within the range from about 32 to about 250° F., and when the sulfide is the desired conversion product, the conversion will be accomplished in a reducing atmosphere at a temperature within the range from about 50 to about 750° F. In those cases where the conversion will occur as the result of decomposition the decomposition will be accomplished by heating the precursor after it has been dissolved in the carbonaceous fluid to its decomposition temperature, generally a temperature within the range from about 250° to about 800° F. In general, the decomposition will occur rapidly as the carbonaceous material containing the precursor or mixture thereof is heated to the temperature at which the metal oxide and/or metal sulfide will react with arsenic and selenium. Since the use of precursors which will decompose upon heating reduces the number of steps required in the process, the use of such precursors is preferred. Moreover, since the sulfide is the most effective form of the metal in reactions with arsenic and selenium, precursors which decompose upon heating to the sulfide are most preferred. Most preferred precursors are, then, various salts or complexes of dithiocarbamic acid, dithiophosphoric acid, and xanthic acid.

In general, the soluble precursor will be added to or combined with the carbonaceous fluid at a concentration which will provide at least at or near a stoichiometric amount of the metal or mixtures thereof based on arsenic and selenium to be separated. In this regard, it should be noted that when the metal oxide and/or metal sulfide are used at stoichiometric concentrations or greater, the arsenic and selenium will be separated as the arsenide and selenide, respectively. When less than stoichiometric amounts of the metal oxide and/or metal sulfide are used, on the other hand, a different set of metal arsenates, metal arsenic sulfides, metal selenates and metal selenium sulfides may be produced.

In the preparation of liquid carbonaceous fluids, from normally solid materials such as oil shale, coal, tar sands and the like, a large portion of the arsenic and/or selenium will remain in the normally solid bottoms product after liquefaction or retorting. This is particularly true when the normally solid bottoms product contains metal sulfides. Notwithstanding this, from about 4 to about 8% of the total arsenic and/or selenium originally in the liquefaction or retorting feed will be found in the liquid product from the liquefaction or retorting operation. As a result, arsenic and/or selenium at concentrations up to about 100 ppm may be contained in such liquid products although concentrations within the range from about 10 to 30 ppm are more typical. The chemical form of the arsenic and/or selenium in the liquid depends primarily upon the source of the liquid and the liquefaction or retorting conditions. Generally, however, the arsenic may be found in a volatile form such as arsenic (III) oxide, arsenic sulfides, elemental arsenic (particularly when the carbonaceous fluid is produced under reducing conditions such as hydroliquefaction or hydroretorting) and organoarsenic compounds. Moreover, a small amount of arsenic may be associated with any fines contained in the oil. Similarly corresponding selenium compounds may be present and selenium may be associated with any fines contained in the carbonaceous fluid. In order to prevent poisoning of downstream catalyst used in various product upgrading steps, arsenic and/or selenium levels must be reduced to less than about 1 ppm. Moreover, and to avoid environmental pollution problems, it is most desirable to remove all arsenic and/or selenium from carbonaceous fluids prior to their use as a fuel.

After the selected precursor or mixture thereof has been added to or combined with the carbonaceous fluid at a concentration within the range from about 0.5 times (x) to about 2.0 times (x) the stoichiometric amount required to convert all of the arsenic and/or selenium contained in the carbonaceous fluid, the precursor or mixture thereof will be converted to an active reaction species. In those embodiments where a conversion reaction other than heating is required, the conversion will, generally, be accomplished in a separate stage. In those embodiments wherein the precursor is separately converted to the corresponding oxide, the conversion will be accomplished in an oxidizing atmosphere at a temperature within the range from about 32 to about 250° F. and at a nominal holding time within the range from about 10 to about 240 minutes. In those embodiments wherein the precursor is separately converted to the corresponding sulfide, the conversion will be accomplished in a reducing atmosphere at a temperature within the range from about 50° to about 750° F. and with a nominal holding time within the range from about 10 to about 180 minutes. In those embodiments wherein the precursor is converted either to the oxide or the sulfide via thermal decomposition, the decomposition will, generally, be accomplished as the carbonaceous fluid is heated to the temperature at which it will be reacted with the arsenic and/or selenium.

After the selected precursor or a mixture of such precursors has been converted either to the corresponding oxide or sulfide, the same will then be reacted with the arsenic and selenium contained in the carbonaceous fluid at a temperature generally within the range from about 300° to about 800° F. The reaction will be accomplished in an inert or reducing atmosphere. In this regard, it should be noted that nitrogen at a pressure within the range from about 300 psia to about 2500 psia may be used to maintain an inert atmosphere. Similarily, carbon monoxide and/or hydrogen at a pressure within the range from about 300 to about 2500 psia may be used to maintain a reducing atmosphere. Preferably, the reaction between the metal oxide and/or metal sulfide and the arsenic and/or selenium will be accomplished at a temperature within the range from about 500° F. to about 750° F. and at a pressure within the range from about 500 psia to about 1500 psia. The carbonaceous fluid will be held at these conditions for a nominal holding time within the range from about 10 to about 180 minutes. During this reaction, the arsenic will be converted to the corresponding metal arsenate, metal arsenide or the metal arsenic sulfide, all of which are solid, and all of which may be separated using conventional means such as filters, centrifuges, packed beds, distillation and the like. Similarly, selenium would be converted to the corresponding metal selenate, metal selenide or metal selenium sulfide which would be subject to separation in the same manner.

In general, the separation of metal arsenic and/or selenium conversion product(s) may be accomplished at any temperature at which the carbonaceous fluid is liquid. Preferably, the separation will be accomplished at a temperature within the range from about 50° to about 250° F. and at a pressure within the range from about 0 to about 100 psig.

After, separation of the arsenic and/or selenium, the carbonaceous fluid may be subjected to further catalytic processing such as cracking, hydrocracking, reforming and the like. Moreover, the final products may be used as fuels or as a source of chemicals without concern with respect to environmental pollution.

PREFERRED EMBODIMENT

In a preferred embodiment of the present invention, a precursor of a metal selected from the iron group of metals (viz., cobalt and nickel) which will decompose to the corresponding metal sulfide upon heating will be used. Preferred precursors, then, include the mono and dihydrocarbyl substituted metal complexes of dithiocarbamic acids, dithiophosphoric acids or xanthic acid. In general, the hydrocarbyl substituents, including the hydrocarbon portion of the ligand, will comprise from about 1 to about 18 carbon atoms and each of the hydrocarbyl substituents may be straight or branched chained, cyclic, cyclic with straight or branched chain hydrocarbyl substituents or aromatic. In a preferred embodiment and when a metal complex of xanthic acid is used, the hyddrocarbyl substitution portion will be a straight or branched chain and will contain from about 1 to about 8 carbon atoms. In a preferred embodiment, and when a metal complex of a dithiocarbamic acid is used, a dihydrocarbyl substituted dithiocarbamate wherein the hydrocarbyl substitutions are the same straight chain, branched chain or substituted cyclic or aromatic radicals having from about 1 to about 8 carbon atoms will be used. In a preferred embodiment and when a metal complex of dithiophosphoric acid is used the hydrocarbyl sutstituted portions will be straight or branched chain radicals and/or substituted cyclic or aromatic radicals having from about 1 to 8 carbon atoms. In a most preferred embodiment of the present invention nickel will be used as the metal component.

In the preferred embodiment, the decomposable precursor will be used in a process to separate arsenic from a shale oil distillate fraction having an initial boiling point within the range from about 100° to about 150° F. and a final boiling point within the range from about 1050° to about 1200° F. The decomposable precursor will be converted to the corresponding metal sulfide by heating the same to the temperature at which the sulfide will react with arsenic in a reducing atmosphere. In the preferred embodiment, the reaction will be accomplished at a temperature within the range from aobut 500° F. to about 750° F., most preferably at a temperature within the range from about 680° F. to about 750° F., at a pressure within the range from about 500 to about 1500 psia, and at a nominal holding time within the range from about 10 to about 120 minutes. The metal arsenide and/or the metal arsenic sulfide will be separated by conventional methods such as distillation which will leave the arsenic compounds as the bottom fraction. Filtration to remove metal arsenides may also be used.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

Example 1

In this example, the effectiveness of the method of this invention to convert an arsenic compound in a selected carbonaceous composition was determined by reacting certain selected compounds of arsenic with a metal organic complex of nickel, namely bis-(butyldithiocarbamato)Ni, abbreviated NiBuDTC. In this example, a series of runs were conducted in a 300 ml stirred autoclave at different nickel: arsenic ratios. The conditions of reaction were changed over relatively wide ranges, thus reaction temperature was varied from 550° to 650° F.; the nominal holding time was changed from 1 to 3 hours and the gaseous environment was changed from nitrogen at 500 psig in runs 1 and 2 to hydrogen in runs 3–9 while the total pressure was varied between 500 psisg (runs 4,6,7 and 9) to 1000 psig (runs 3, 5 and 8.) In all of these runs, 60g of kerosene was used as the selected carbonaceous material. After the reaction time, the autoclave was allowed to cool and the products were collected by filtration and analyzed by x-ray diffraction. The conditions used in each run, the arsenic compound used and the conversion products obtained are summarized in the following table. As will be clear from the table, the nickel organic complex is a very effective reagent to react with, and hence, scavenge arsenic from liquid carbonaceous materials.

TABLE

| Run No. | BuDTC Ni, gm | As, Type | As, gm | T, °F. | Holding Time, Hrs. | Products |
|---|---|---|---|---|---|---|
| 1 | 3.552 | $As_2O_3$ | 1.001 | 550 | 2 | NiAsS |
| 2 | 8.901 | $As_2O_3$ | 1.000 | 550 | 2 | NiAsS, NiS |
| 3 | 8.913 | $As_2O_3$ | 1.002 | 550 | 2 | NiS,NiAs,NiAsS |
| 4 | 2.66 | $As_2O_3$ | 0.73 | 650 | 1 | NiAsS,NiAs |
| 5 | 1.32 | $As_2O_3$ | 0.37 | 650 | 1 | NiAs |
| 6 | 5.61 | $(Bu)_3As$ | 3.0cc | 650 | 3 | NiAsS |
| 7 | 1.32 | As | 0.28 | 650 | 1 | NiAsS |
| 8 | 2.11 | $As_2O_3$ | 0.20 | 650 | 2 | $Ni_{11}As_8$ |
| 9 | 2.213 | PhAsOOH | 1.005 | 600 | 2 | NiAs |

EXAMPLE 2

In this experiment, another metal organic complex, namely dioxobis(dithiocarbamato)Mo(VI), abbreviated MoDIBuDTC, $As_2O_3$ and 60g of kerosene were placed in a stirred, 300 ml autoclave, the autoclave was pressurized with hydrogen and the reaction was carried out at 650° F. for 2 hours to ascertain that the sulfide of Mo (the thermal decomposition product of MoDIBuDTC) would react with the As. After allowing to cool, the contents of the autoclave were filtered and analyzed. The product was found to be poorly crystallized $Mo_x$-As2 or $Mo_5As_4$ by x-ray diffraction analysis.

EXAMPLE 3

The experiment of Example 2 was repeated with the exception that tris(butyldithiocarbamato)Co, (CoBuDTC) was used in place of MoDiBuDTC. The product was characterized as CoAsS.

EXAMPLE 4

The experiment of Example 2 was again repeated with the exception that bis(butylxanthato)Ni, (NiBuXan), was used to react with $As_2O_3$. The products obtained were identical to those obtained in Example 1 under similar conditions.

EXAMPLE 5

The experiment given in Example 2 was repeated with the exception that bis(dibutyldithiocarbamato)Ni, (NiDiBuDTC), was used. Again, the same nickel arsenic compounds identified in Example 1 were obtained.

EXAMPLE 6

In this experiment, tris(dibutyldithiocarbamato) Fe, (FeDiBuDTC), $As_2O_3$ and kerosene were combined together, in the same manner as used in Example 2. Formation of iron arsenic compounds was not observed. Instead, metallic arsenic was identified by x-ray diffraction analysis. This example clearly demonstrates that organic complexes of iron do not react with arsenic compounds in the presence of sulfur.

EXAMPLE 7

In this experiment, the effectiveness of metal organic complex to remove arsenic from shale oil containing arsenic was determined. For the experiment 1 g of NiBuDTC, 100 g of Paraho shale oil containing 73 ppm of arsenic and 0.5 g of $CS_2$ were placed in an autoclave. The autoclave was pressurized with hydrogen and heated to 600° F. Total pressure was maintained at 500 psig at 600° F. for 120 minutes. After cooling, the contents were transferred to a beaker and the autoclave was washed with toluene. The washings were combined with the oil and then filtered. The solution was analyzed for arsenic by x-ray fluorescence. The product contained 1.6 ppm of arsenic based upon the shale oil, or 97.8% of the arsenic in the feed was removed.

EXAMPLE 8

In this example, the influence of shale oil fines on the arsenic removal efficiency with metal organic complexes was determined. For this purpose, the procedure summarized in Example 7 was repeated with the exception that to the mixture 10 g of combusted Kerosene Creek oil shale fines were also added. Total arsenic in the product was 1.1 ppm which is equal to 98.4% arsenic removal.

EXAMPLE 9

The experiment given in Example 8 was repeated with the exception that 10g of Colorado oil shale fines were used. A 96.5% dearsenation was obtained.

EXAMPLE 10

In this experiment, MoDiBuDTC was used as a metal organic complex to remove arsenic from a shale oil in a continuous unit. The shale oil contained 14 ppm of arsenic. The molydithiocarbamate was dissolved in the shale oil to give a concentration of 100 ppm Mo on feed. the flow rate of oil through the reactor was varied between from 500 and 1500 cc/hr, the pressure was 1200 psia, $H_2$ and the temperature was varied from 600° F. to 675° F. The nominal residence time was 1 to 3 hours. The total arsenic in the product was 2.9 ppm at 600° F., 2 ppm at 650° F. and less than 1.0 ppm at 675° F. This example clearly shows the effect of temperature on the separation, with higher temperatures being far more effective at any given holding time.

While the present invention has been described and illustrated: by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A method for separating arsenic and/or selenium from a shale oil consisting essentially of the steps of:

(a) combining said shale oil with a metal complex, selected from the group consisting of the mono- and dihydrocarbyl-substituted metal complexes of dithiocarbamic acids, dithiophosphoric acids and xanthic acid, said metal being selected from the metals of Groups VI-A and VIII-A of the Periodic Table of the Elements, and mixtures thereof, which metal complex is soluble in said shale oil and which will decompose to the corresponding metal sulfide;

(b) converting said metal complex to the corresponding metal sulfide by heating;

(c) contacting said shale oil and said converted metal complex at a temperature within the range from about 300° F. to about 800° F. in an inert or reducing atmosphere for a period of time within the range from about 10 to about 180 minutes, such that said converted metal complex reacts with arsenic and/or selenium in the shale oil;

(d) separating the reacted arsenic and/or selenium from said shale oil; and (e) recovering a shale oil having a reduced concentration of arsenic and/or selenium.

2. The process of claim 1 wherein said metal complex is added at a molar concentration within the range from about 0.5 to about 2 times the stoichiometric amount required to convert all of the arsenic and/or selenium in said shale oil.

3. The process of claim 2 wherein said metal is selected from the group consisting of molybdenum, nickel and cobalt.

4. The process of claim 1 wherein the contacting is accomplished at a temperature within the range from about 500° to about 750° F.

5. The process of claim 4 wherein a reducing atmosphere is maintained with a gas comprising molecular hydrogen.

6. The process of claim 1 wherein said contacting is accomplished at a temperature within the range form about 680° F. to about 750° F.

7. The process of claim 6 wherein the metal is selected from the Group consisting of cobalt and nickel.

* * * * *